US009003971B2

(12) United States Patent
Haenni et al.

(10) Patent No.: US 9,003,971 B2
(45) Date of Patent: Apr. 14, 2015

(54) APPARATUS FOR AND METHOD OF PRODUCING PROOF PRINTS

(75) Inventors: Michael Haenni, Zurich (CH); Christoph Bugs, Zurich (CH)

(73) Assignee: Digital Information Ltd., Zurich (CH)

( * ) Notice: Subject to any disclaimer, the term of this patent is extended or adjusted under 35 U.S.C. 154(b) by 525 days.

(21) Appl. No.: 12/473,076

(22) Filed: May 27, 2009

(65) Prior Publication Data

US 2009/0293750 A1 Dec. 3, 2009

(30) Foreign Application Priority Data

May 28, 2008 (EP) ..... 08009678

(51) Int. Cl.

| | |
|---|---|
| ***B41F 1/54*** | (2006.01) |
| ***B41J 3/60*** | (2006.01) |
| ***B41J 3/42*** | (2006.01) |
| ***B41J 11/46*** | (2006.01) |

(52) U.S. Cl.

CPC .... *B41J 3/60* (2013.01); *B41J 3/42* (2013.01); *B41J 11/46* (2013.01)

(58) Field of Classification Search

CPC ..... B41J 3/42; B41J 3/60; B41J 11/46
USPC ..... 101/93.11, 93.12, 484, 485, 227, 228, 101/483, 486
See application file for complete search history.

(56) References Cited

U.S. PATENT DOCUMENTS

| | | | | |
|---|---|---|---|---|
| 5,704,282 | A * | 1/1998 | Khalid | 101/93.01 |
| 5,868,069 | A | 2/1999 | Khalid et al. | |
| 6,211,949 | B1 * | 4/2001 | Dybdal et al. | 355/72 |
| 6,763,220 | B2 * | 7/2004 | Nakazawa | 399/401 |
| 6,950,206 | B1 * | 9/2005 | Karsten et al. | 358/1.18 |
| 7,878,617 | B2 * | 2/2011 | Mizes et al. | 347/19 |
| 2002/0084648 | A1 * | 7/2002 | Pierce et al. | 283/72 |
| 2002/0131804 | A1 | 9/2002 | Nakazawa et al. | |
| 2003/0039496 | A1 | 2/2003 | Miyamoto et al. | |
| 2005/0066831 | A1 | 3/2005 | Karsten et al. | |
| 2007/0133057 | A1 * | 6/2007 | Fukunishi | 358/1.18 |
| 2008/0266607 | A1 * | 10/2008 | Morita | 358/1.18 |

FOREIGN PATENT DOCUMENTS

| | | |
|---|---|---|
| JP | 60-54872 A | 3/1985 |

* cited by examiner

*Primary Examiner* — Ren Yan
*Assistant Examiner* — Marissa Ferguson Samreth
(74) *Attorney, Agent, or Firm* — Birch, Stewart, Kolasch & Birch, LLP

(57) ABSTRACT

An apparatus for producing proof prints on which the correctness of page impositions can be checked comprises a stand configured to receive a roll of paper. A first printer and a second printer are provided for printing pages on the front side and the rear side, respectively, of a paper web fed from the paper roll. An optical sensor is arranged between the first printer and the second printer. The optical sensor is configured to detect the position of an alignment mark which has been printed by the first printer on the front side of the paper. A control unit modifies the spatial relationship between the rear side of the paper and what is printed on the rear side of the paper depending on the detected position of the alignment mark. This can be accomplished either by electronically modifying the second pages as such, or by mechanically modifying the paper position with respect to a printing head contained in the second printer.

16 Claims, 7 Drawing Sheets

APPARATUS FOR AND METHOD OF PRODUCING PROOF PRINTS

BACKGROUND OF THE INVENTION

1. Field of the Invention

The invention relates to an apparatus for and a method of producing proof prints on which the correctness of page impositions can be checked.

2. Description of Related Art

In the printing industry it is usually necessary to verify data files before printing plates for a printing press are produced. Such a verification, which is also referred to as proofing, usually involves the production of proof prints, i.e. printouts of the data files, using a laser printer, a color printer or a similar low resolution device. The proof prints are then visually inspected so as to detect the correctness of the page impositions. The term imposition is commonly used to denote the correct sequential arrangement of pages that are to be printed, and also includes the proper alignment of page margins (sometimes referred to as registration). In books produced from a printing sheet having incorrect impositions, the margins on the front side and the rear side of a page may not coincide, or the sequence of the pages is not correct, for example.

When films are used to produce plates for the printing press, the films can be used for proofing purposes before the plates are imaged and printed. With the trend to eliminate films and to use "computer-to-plate" systems instead, films are not longer available for proofing.

In the printing industry special apparatus are used for the production of proof prints. These apparatus are sometimes referred to as pre-proofers and usually contain an arrangement of one or two printers which are used to sequentially print pages on a front and a rear side of a sheet of paper.

SUMMARY THE INVENTION

It is an object of the present invention to provide an apparatus for and a method of producing large proof prints on which the correctness of page impositions can be checked.

With regard to the apparatus, this object is solved, in accordance with the present invention, by an apparatus comprising a stand configured to receive a roll of paper, a first printer for printing pages on a front side of the paper fed from the paper roll, and a second printer for printing pages on a rear side of the paper. The apparatus furthermore comprises an optical sensor which is arranged between a paper exit of the first printer and a paper entrance of the second printer. The optical sensor is configured to detect the position of an alignment mark which has been printed by the first printer on the front side of the paper. A control unit is provided which is configured to modify the spatial relationship between the rear side of the paper and what is printed on the rear side of the paper depending on the detected position of the alignment mark.

The apparatus in accordance with the present invention does not require that separate sheets of paper fall down from the paper exit of the first printer to the paper entrance of the second printer. Instead, it is possible to guide a paper web of (in principle) unrestricted length between the two printers. Possible misalignments, rotations or scaling errors which may occur as a result of varying printing or ink conditions in the first printer, for example, may be compensated for otherwise. More specifically, this compensation is achieved with the help of the optical sensor which, in conjunction with the control unit, ensures that possible misalignments between the two printers, and in some embodiments even paper shrinkage and other sources of error, are compensated for by modifying the spatial relationship between the rear side of the paper and what is printed on the rear side of the paper. The modification may be accomplished either by electronically modifying the second pages as such, or by mechanically modifying the paper position with respect to a printing head contained in the second printer.

In either case the optical sensor measures, by detecting the alignment mark printed by the first printer and comparing same with target values, any deviations which may have occurred during the printing of pages in the first printer. These deviations are communicated to the control unit. The control unit then modifies the pages to be printed on the rear side of the paper, thereby taking account the type and quantity of the deviations measured by the optical sensor, or it modifies the paper position, for example by controlling rollers that feed the paper to the printing head. The pages printed on the rear side of the paper will finally have the positional relation to the pages on the front side which was originally intended.

The modification of what is printed by the second printer on the rear side of the paper may include a displacement, a rotation or a change of scale of the pages.

If the modification consists only of a longitudinal or lateral displacement, it may suffice for the control unit to have access to an imposition data memory, in which digital imposition information representing page impositions for the front side and the rear side of the paper are stored. The control unit may then be configured to modify the digital imposition information such that it represents displaced page impositions for the rear side of the paper. In this case digital page information representing the individual pages do not have to be modified as such, since only the overall position of the pages are modified.

If the control unit (also) has to rotate and/or change the scale of pages to be printed on the rear side of the paper, it may be necessary to give the control unit also access to a page data memory, in which digital page information representing the individual pages to be printed on the front side and the rear side of the paper are stored. The control unit is then configured to modify the digital page information such that it represents rotated or scaled pages to be printed on the rear side of the paper.

The alignment mark may comprise two or more orthogonal lines or any other pattern that makes it possible to determine whether the alignment mark, which was printed by the first printer on the front side of the paper, has been printed at the position, orientation and size as intended. In an alternative embodiment, the alignment mark is a code stripe containing a code which encodes the absolute position of the paper along a paper feeding direction.

The optical sensor provided for detecting the alignment mark may contain a two dimensional array of light sensitive elements such as CCD or CMOS pixels. In one embodiment the optical sensor is configured to produce stills and may be synchronized with a flash light. In another embodiment the optical sensor is a video camera which produces a consecutive sequence of images of the alignment mark.

In other embodiments a second optical sensor is provided that is arranged between the paper exit of the first printer and the first sensor. The second sensor is also configured to detect the position of the alignment mark. The combination of two optical sensors makes it possible to more accurately determine any malfunctions (such as paper jam) of either of the printers, and it also enhances the accuracy of the alignment of what is printed on the front and the rear side of the paper.

Preferably the first and second printers are inkjet or laser printers, but other types of printers or plotters are envisaged as well.

In still another embodiment the apparatus comprises a paper cutter which is arranged at a paper exit of the second printer. This makes it possible to cut the paper web after the pages have been printed on both sides of the web, with no risk of disturbing the correct alignment between the two printers by a cutting process.

With regard to the method, the above stated object is solved by a method comprising the following steps:

a) a computer prepares first pages and second pages;
b) paper is fed from a paper roll into a paper entrance of a first printer;
c) the first printer prints the first pages and an alignment mark on a front side of the paper;
d) an optical sensor detects the position of the alignment mark;
e) a control unit modifies, depending on the position detected in step d), the spatial relationship between the rear side of the paper and the second pages;
f) a second printer prints the modified second pages on the rear side of the paper with the modified spatial relationship.

With regard to the advantages associated with this method and various embodiments thereof, reference is made to what has been explained above with regard to the apparatus.

This method may be part of a method of checking the correctness of impositions of pages on a front side and a rear side of a printing sheet. More specifically, after the proof prints have been produced, it is first checked whether the impositions on the proof print are correct. If this is the case, printing sheets with the original impositions will printed in a printing press. Otherwise the control unit modifies, depending on the results obtained in the checking step, the impositions of the first and/or the second pages.

After this modification, one may proceed directly with producing printing plates for the printing press with the modified impositions, or with producing another proof print in order to check whether the modified impositions are now correct.

Checking of the impositions will usually be performed visually, but may also be carried out with the help of image processing means.

BRIEF DESCRIPTION OF THE DRAWINGS

Various features and advantages of the present invention may be more readily understood with reference to the following detailed description taken in conjunction with the accompanying drawing in which.

DESCRIPTION OF PREFERRED EMBODIMENTS

Figures 1A, 1B:
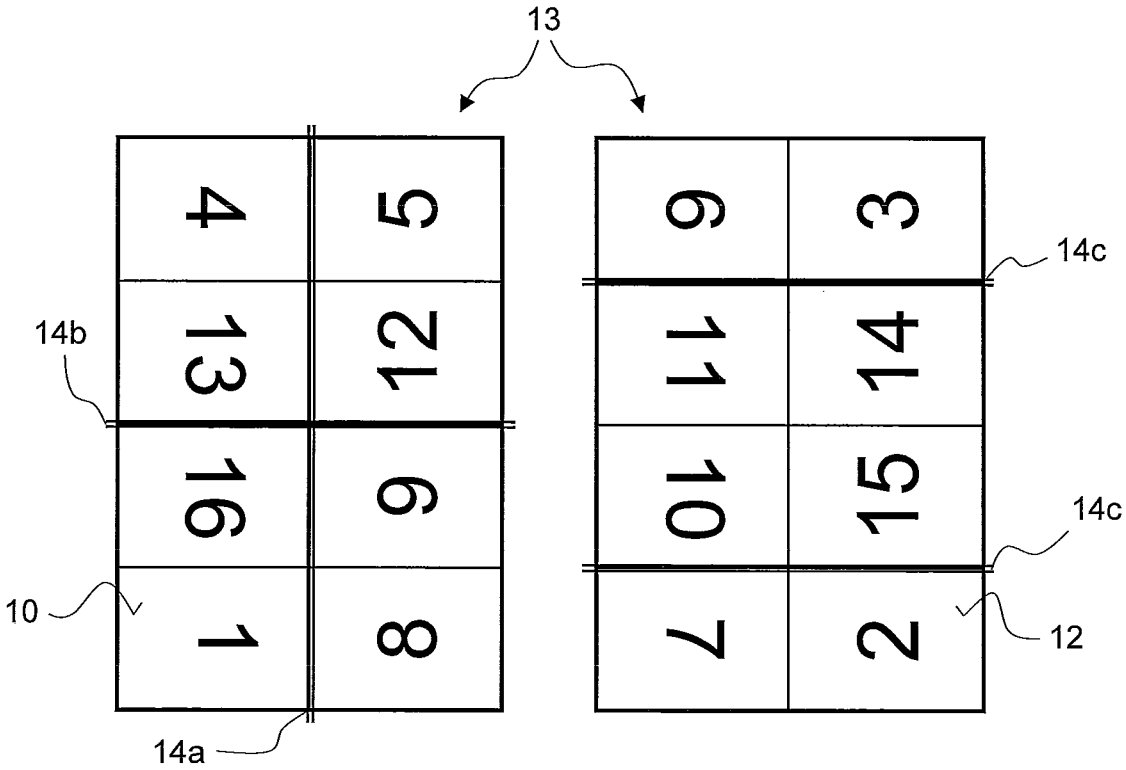
FIGS. 1*a* and 1*b* show the impositions of 16 pages to be printed on a front and a rear side of a print sheet, respectively.

FIGS. 1*a* and 1*b* show a front side 10 and a rear side 12, respectively, of a printing sheet 13 containing 16 pages. The pages are numbered consecutively from 1 to 16 and may later form a portion of a book or a booklet, for example. To this end the printing sheet 13 may be folded, cut and bound after the pages have been printed on the front side 10 and the rear side 12 in a printing press.

The arrangement of the pages on the front side 10 and the rear side 12 required for obtaining a consecutive sequence of pages depends on the applied folding scheme. In FIGS. 1*a* and 1*b* it is assumed that the printing sheet is first folded along a first fold line 14*a*, then folded along a second fold line 14*b* and finally folded along a third fold line 14*c*.

For cost reasons the impositions of the pages should be correct before the plates for the printing press are produced. Otherwise new plates have to be produced which is a costly and time consuming process. The term imposition denotes the correct sequential arrangement of the pages on a sheet of paper, including the correct alignment of the page margins etc. For example, it is often desired that the page numbers printed on the front and the rear side of a single printed page coincide.

The basic arrangement of the pages as such is usually a task which is carried out by a computer to which the required information relating to the folding scheme is supplied. However, proper alignment of the pages is a major issue during the imposition process. One reason for this is that the various machines used in the finishing process after the sheet has been printed have tolerances and are subject to wear and changing environmental conditions. Therefore it may happen that a perfect alignment of page margins achieved on a computer screen is not maintained in the finished product. But even without such finishing steps it often happens that pages on the front and the rear side of the sheet of paper, for example pages 3 and 4 in FIGS. 1*a* and 1*b*, are not properly aligned with respect to each other.

Figure 2:
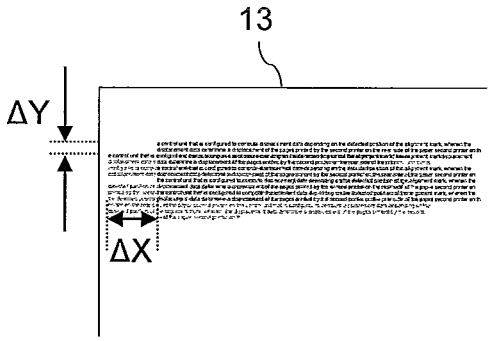
FIG. 2 illustrates the offset of page margins on a front and a rear side of a printing sheet.

FIG. 2 illustrates this problem by showing a top-left corner of a finished page containing text on the front page and the rear page (shown in grey scale). Here it is assumed that the text printed on the front side and the rear side of the sheet of paper was meant to be perfectly aligned, i.e. the text margins should coincide on the front and the rear side. In the illustration of FIG. 2, however, these margins do not coincide, but are displaced by a lateral offset $\Delta X$ and a longitudinal offset $\Delta Y$.

In order to avoid untolerable imposition errors, proof prints are often produced on a pre-proofer which produces one or a small number of proof prints that resemble as much as possible the printing sheets that would be obtained if the printing press had been used instead. The proof prints may be visually inspected immediately after they have been printed, additionally after folding, or again after finishing steps such as cutting or binding. If an intolerable imposition error occurs, for example a wrong page orientation or (more frequently) an alignment error, the spatial relationship between the paper and what is printed on the paper can be adjusted. For example, in a situation as shown in FIG. 2, the relative position of the pages could be corrected by displacing the paper both laterally and longitudinally as to reduce the offsets ΔX and ΔY. Instead of mechanically displacing the paper, the print data could be modified to achieve the same effect. After this adjustment step, another proof print may be produced by the pre-proofer, and the impositions are checked again. Usually it requires only one or two such proof prints and imposition checking steps until the imposition is sufficiently correct.

Figure 3:
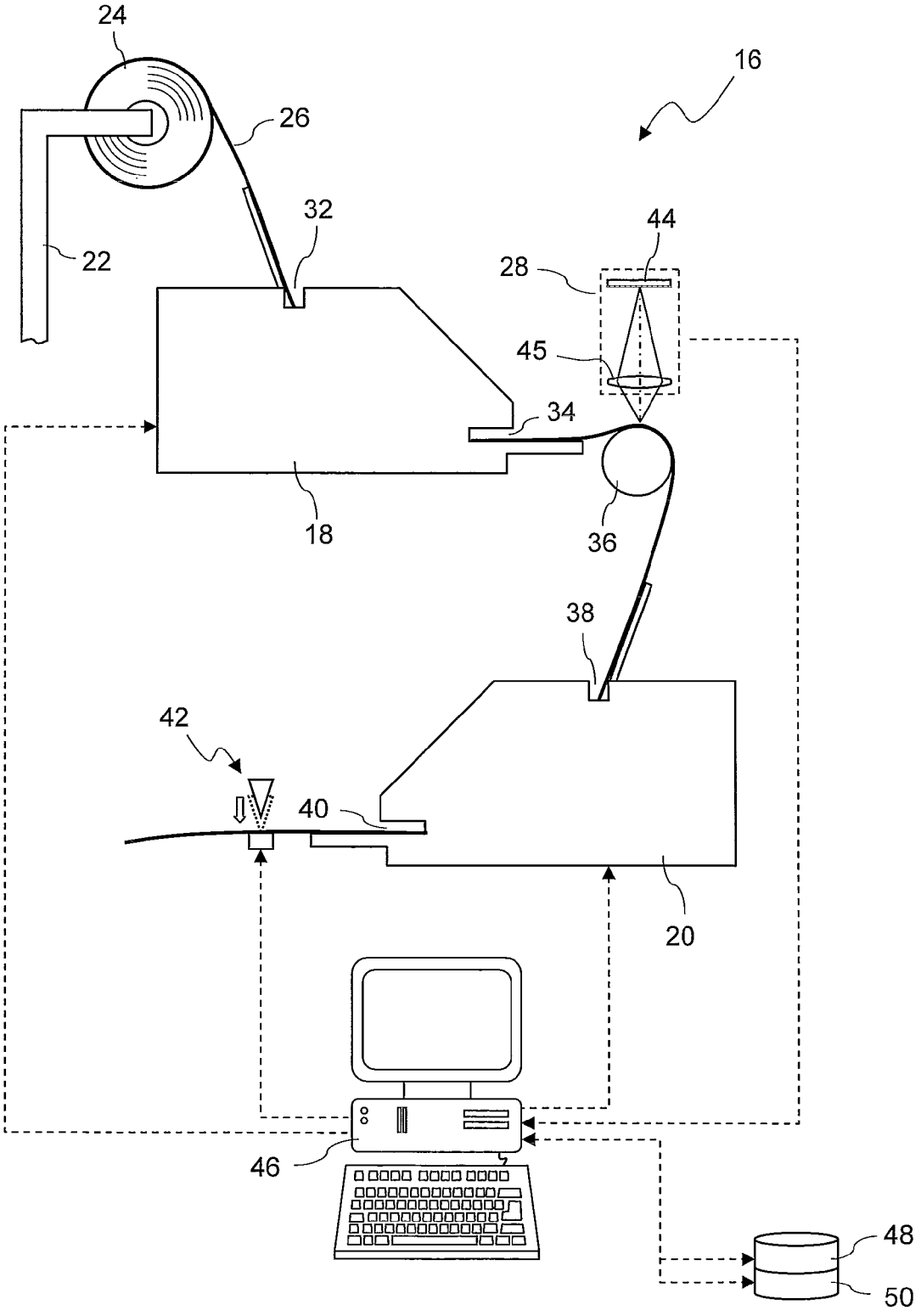
FIG. 3 is a schematic illustration of an apparatus in accordance with a first embodiment of the present invention.

FIG. 3 is a schematic illustration of a pre-proofer 16 in accordance with a first embodiment of the present invention. The pre-proofer 16 comprises as main components a first printer 18, a second printer 20, a stand 22 configured to receive a roll 24 from which a paper web 26 can be rolled off, and a video camera 28. The first and second printers 18, 20 are, in the embodiment shown, inkjet printers which are capable of producing color prints on one side of sheets or webs of paper having a maximum width of 62 inch (about 157 cm). However, other types of printers, for laser printers or printers for other print formats, may be used instead.

The second printer 20 is arranged below the first printer 18 and rotated by 180° around a vertical axis so that a front side printed in the first printer 18 becomes the rear side in the second printer 20. As a result of this arrangement, the first printer 18 prints only the pages on the front side of the paper web 26, and the second printer 20 prints only the pages on the rear side of the paper web 26.

The paper web 26 rolled from the paper roll 24 is fed to a paper entrance 32 of the first printer and leaves the first printer at its paper exit 34. The paper web 26 is then fed via a roller 36 on a short paper path to a paper entrance 38 of the second printer 20. The paper web 26 leaves the second printer at its paper exit 40. There an optional paper cutter indicated at 42 is positioned.

The video camera 28 is arranged between the paper exit 34 of the first printer 18 and the paper entrance 38 of the second printer 20. In the embodiment shown, the video camera 28 is arranged such that it can inspect a portion of the paper web 26 running over the roller 36. However, other positions of the video camera 28 may be envisaged as well, for example immediately at the paper exit 34 of the first printer, immediately in front of the paper entrance 38 of the second printer 20 or even within the housing of the first or second printer 18 and 20, respectively. The video camera 28 comprises an image sensor 44, for example a CCD sensor including an array of CCD image pixels, and optics indicated as single lens 45 which images a portion on the paper web 26 positioned within an object field of the camera 28 on the image sensor 44. The object field of the camera 28 may be a square of about 2×2 inches (about 5.08 cm).

An additional light source (not shown) may be provided in the vicinity of the video camera 28 so as to illuminate the object field on the paper web 26 if the light conditions in the surroundings of the apparatus 16 are not sufficient.

The first printer 18, the second printer 20, the video camera 28 and the optional paper cutter 42 are connected to a computer 46 which controls the function of said components. The computer 46 is furthermore connected to (or contains) an imposition data memory 48, in which digital imposition information representing page impositions for the front side and the rear side of the paper web 26 are stored. The computer 46 is furthermore connected to (or contains) a page data memory 50, in which digital page information representing the individual pages to be printed on the front side and the rear side of the paper web 26 are stored. The various data contained in the memories 48, 50 may be supplied from external data sources, or may be produced within the computer 46. In one embodiment the memories 48, 50 are formed as files stored on a hard disk of the computer 46.

In the following the function of the apparatus 16 will be explained with reference to FIGS. 4*a*, 4*b*, 5*a*, 5*b* and 6*a*, 6*b:*

First the computer 46 computes an original imposition for the pages. To this end the computer 46 retrieves data stored in the imposition data memory 48 and the page data memory 50. Data retrieved from the imposition data memory 48 contain an imposition layout which indicates for each page to be printed its orientation and position on the paper web 26. The content of the pages is retrieved from the page data memory 50. The result of this process is a data file containing the complete printer commands for the first and second printer 18, 20 required to print the front side and rear side of the paper web 26.

Figure 4A:
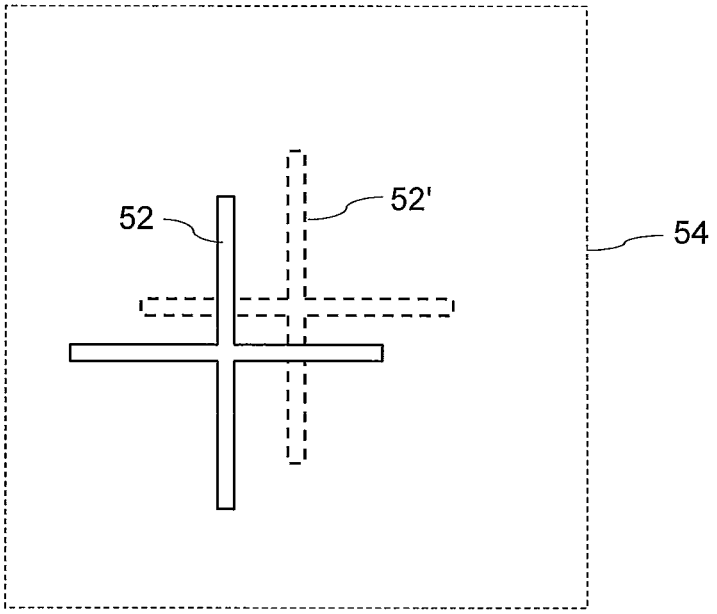
FIG. 4*a* is an image of the alignment mark produced by the optical sensor, wherein the alignment mark is displaced with respect to a target position indicated with dashed lines.

Furthermore the computer 46 generates print commands ensuring that an alignment mark 52 such as shown in FIG. 4*a* is printed on the front side of the paper web 26. This alignment mark is positioned such that it will pass along the object field of the video camera 28.

After the first printer 18 has received its printing commands, it feeds in the paper web 26 from the paper roll 24 into the paper entrance 32 and prints pages and the alignment mark 52 on the front side of the paper web 26. The paper web 26 then passes the video camera 28 and is fed, via the roller 36, into the paper entrance 38 of the second printer 20. The video camera 28 takes an image of the alignment mark on the front side of the paper web 26 and communicates this image to the computer 46. The computer 46 checks whether the image of the alignment mark 52 taken by the video camera 28 is at the target position where it ought to be. A deviation of the alignment mark from its target position may be the result of changing feeding-in conditions at the paper entrance 32, or of fluctuations of paper or ink quality, for example.

FIG. 4*a* illustrates how an alignment mark 52 detected by the video camera 28 may be offset from its target position which is indicated by 52' in FIG. 4*a*. The dashed line 54 represents the outline of the image field of the video camera 28. In the exemplarily configuration shown in FIG. 4*a*, the alignment mark 52 has a larger offset in along the X direction than in the Y direction. Without taking additional measures, these offsets would have the consequence that the pages on the rear side of the paper web 26 would be located at positions which would not correspond to the positions where a printing press would print these pages. As a result, the correctness of the page impositions cannot be checked. For example, incorrect impositions may be determined, although the print press would not produce printing sheets with these impositions.

In order to avoid such offsets produced solely by the apparatus 16, the computer 46 modifies the print commands for the second printer 20 such that the pages will be printed with small displacements in at least one direction. These displacements are computed such that the relative position of the pages on the front side and the rear side do not depend on varying conditions such as paper or ink properties. The larger the offsets of the alignment mark 52 from the target mark 52 are, the larger are the displacements computed by the computer 46 for the pages to be printed on the rear side of the paper web 26.

Figure 4B:
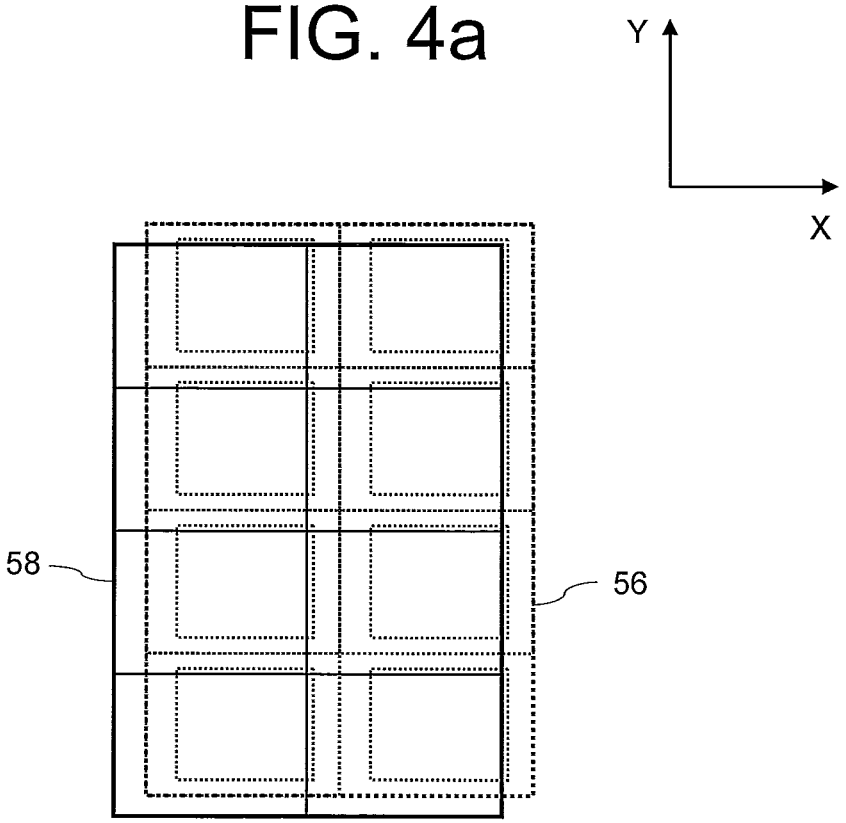
FIG. 4*b* illustrates the displacement of the pages to be printed on the rear side as computed in the control unit.

In the example shown in FIG. 4*a*, the displacements of the pages to be printed by the second printer 20 on the rear side of the paper web 26 is illustrated in FIG. 4*b*. Dotted lines 56 denote the pages that would have been printed by the second printer 20 without the displacements determined by the computer 46 upon comparing the alignment mark 52 with its target position. Solid lines 58 denote the pages displaced both in the X and Y directions and actually printed by the second printer 20.

Instead of or in addition to displacing the pages to be printed on the rear side of the paper web 26, the computer 46 may modify the pages such that they are scaled up or down along at least one direction. Such a situation may occur if the paper web 26 shrinks or expands during the printing process in the first printer 18.

Figure 5A:
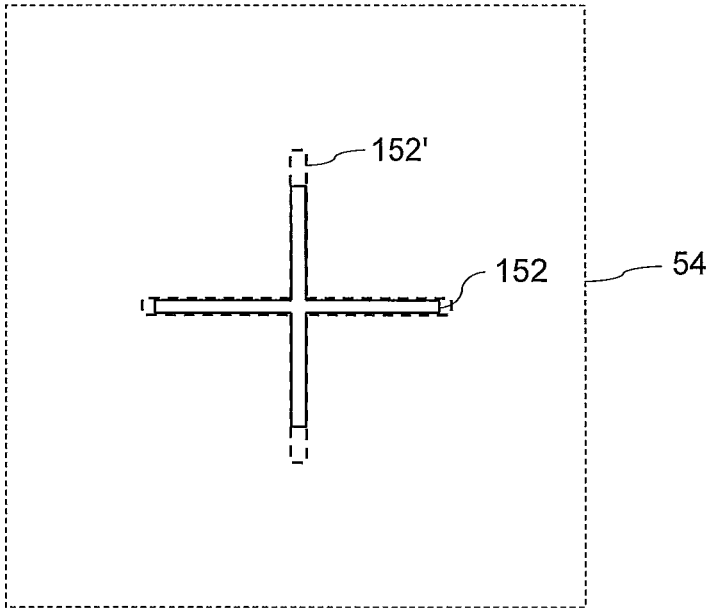
FIG. 5*a* is an image produced by the optical sensor similar to FIG. 4*a*, wherein the alignment mark is scaled down with respect to a target geometry indicated with dashed lines.
Figure 5B:
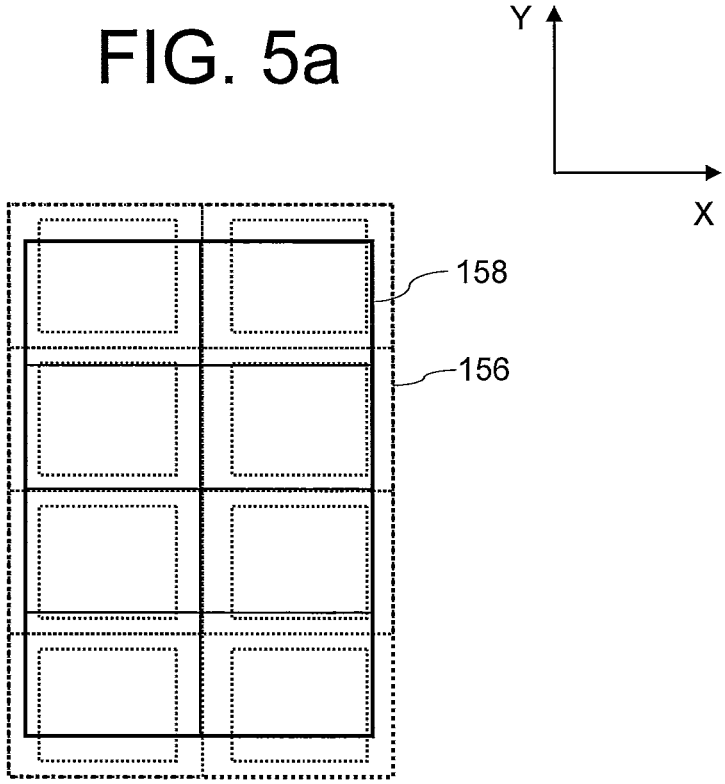
FIG. 5*b* illustrates, for the case shown in FIG. 5*a*, the scaling down of the pages to be printed on the rear side as computed in the control unit.

FIG. 5*a* illustrates this by showing how an alignment mark 152 will have different lengths along the X and Y direction, if the shrinkage of the paper web 26 is direction dependent. Consequently, the computer 46 scales down the pages to be printed on the rear side of the paper web 26. In case of direction dependent shrinkage the scaling factors along the X and Y direction will be different. FIG. 5*b* illustrates how the pages printed on the rear side of the paper web 26 by the computer 46 are scaled down (solid lines 158) in comparison to the original size (dotted lines 156). If no such scaling was performed, the pages printed on the rear side would appear to be too large if compared to the pages printed on the front pages, because the latter have been scaled down as a result of the shrinkage of the paper web 26.

Figure 6A:
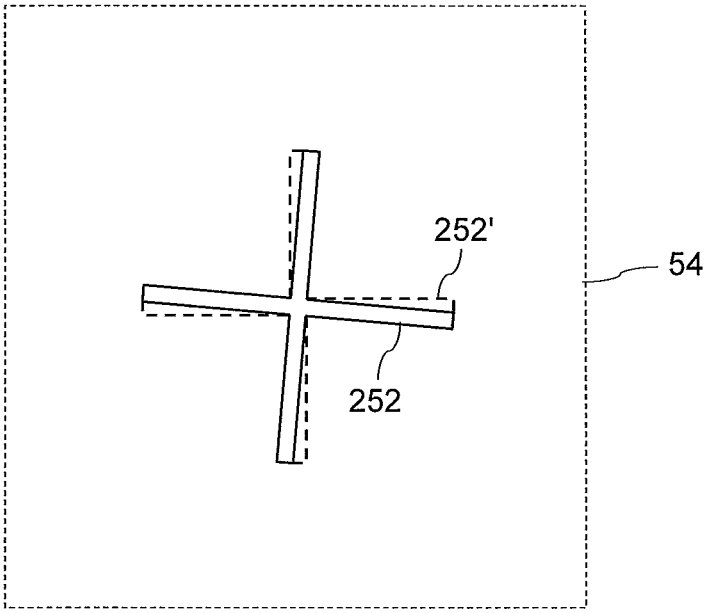
FIG. 6*a* is an image produced by the optical sensor similar to FIG. 4*a*, wherein the alignment mark is rotated with respect to a target position indicated with dashed lines.
Figure 6B:
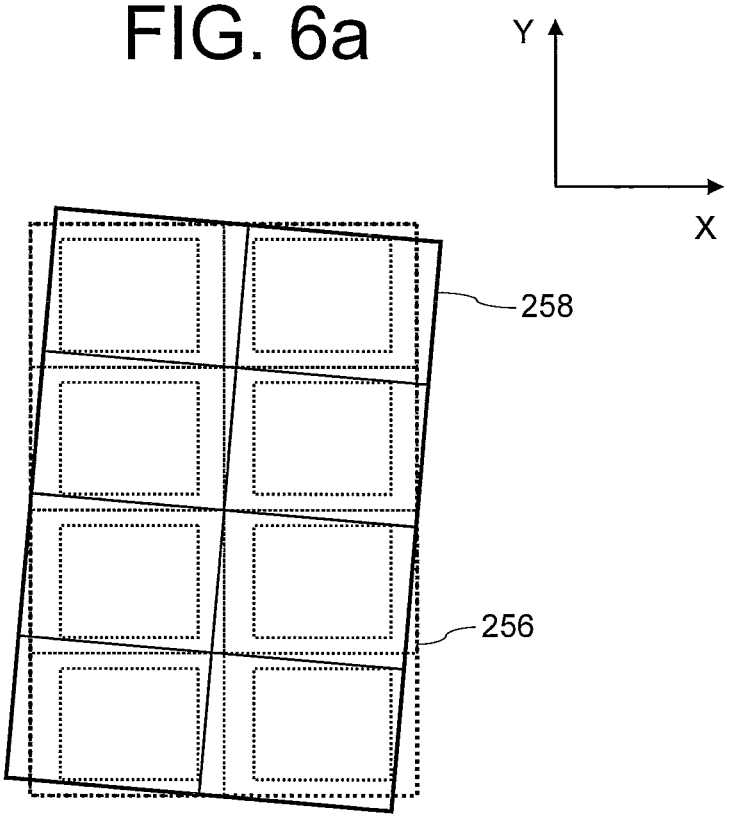
FIG. 6*b* is an illustration similar to FIG. 4*b*, but with rotated pages as computed by the control unit.

Similar considerations apply to rotations of the paper web which may be caused by feed rollers in the first printer 18, for example. If an alignment mark 252 is rotated with respect to its target position 252', as it is shown in FIG. 6*a*, also the pages to be printed on the rear side of the paper web 26 have to be rotated by the same angle. The pages rotated with respect to the original orientation (dotted lines 256) are indicated in FIG. 6*b* by solid lines 258.

Figure 7:
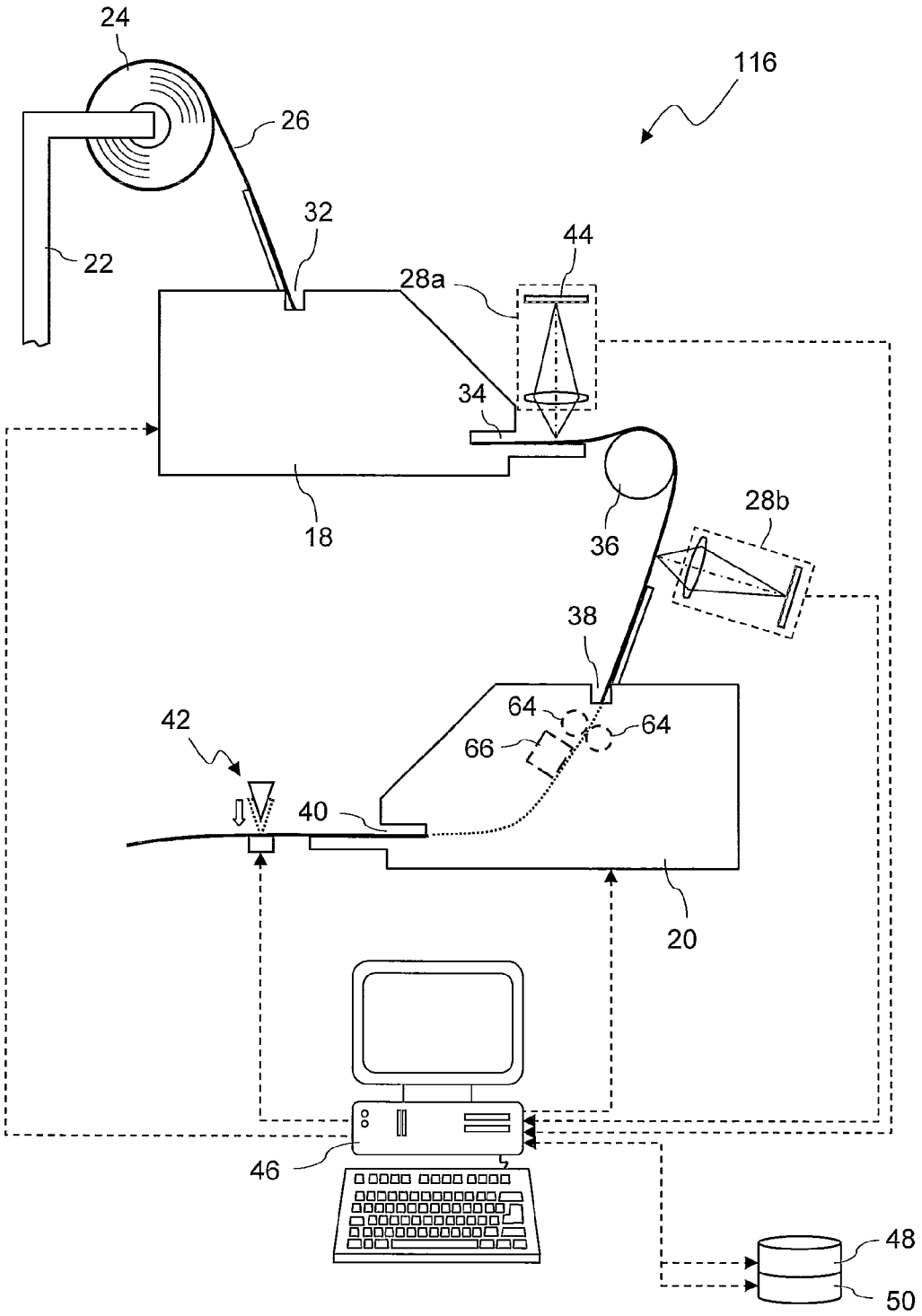
FIG. 7 is a schematic illustration of an apparatus in accordance with a second embodiment of the present invention comprising two video cameras.

FIG. 7 is a schematic illustration of a pre-proofer 116 in accordance with a second embodiment of the present invention. Identical or like elements are denoted with the same reference numerals as used before.

The pre-proofer 116 differs from the pre-proofer 16 shown in FIG. 3 mainly in three respects. The first difference is that it comprises not only one video camera, but two video cameras 28*a*, 28*b* that are connected to the computer 46. The first video camera 28*a* is arranged immediately at the paper exit 34 of the first printer 18, and in a position that is between a body of the first printer 18 and roller 36 which supports the moving print medium 26. The second camera 28*b* is arranged as close as possible to the paper entrance 38 of the second printer 20 and in a position that is between the roller 36 and a body of the second printer 20.

Figure 8:
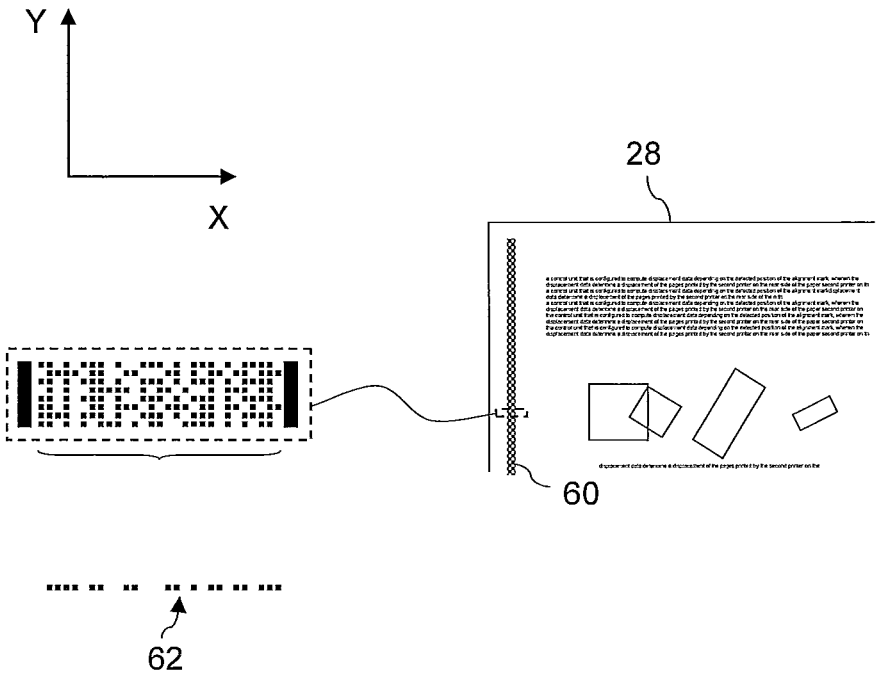
FIG. 8 is a portion of a paper web on which an alignment mark in the form of a binary code stripe has been printed by the first printer.

The second difference is that the first printer 18 of the pre-proofer 116 prints a binary code stripe as alignment mark on the front side of the paper web 26. As can be seen in FIG. 8, which shows a portion of the printed front side, a binary code stripe 60 extends longitudinally along the Y (i.e. feeding) direction of the paper web 26 close to one of the side margins. As illustrated in the cut-out in the left portion of FIG. 8, the binary code stripe 60 comprises a sequence of lines 62 that extend along the X direction and each contain a total of 30 binary digits. The binary code stripe 60 therefore resembles a punch card in which the digits are not punched, but printed by the first printer 18.

Each line 62 encodes a number n between 0 and $2^{30} \approx 10^9$. This number is used, in the context of the present embodiment, to determine an absolute position of the paper web 26 along the Y direction, i.e. the direction along which the paper web 26 is guided through the pre-proofer 116. If the height of the lines 62 along the Y-direction is selected to be 0.5 mm, Y positions of a paper web having a total length of 500 km could be encoded. Since there are no paper rolls 24 having such a length, some of the digits may be used for other purposes, for example for encoding paper jam information or other printing parameters occurring in the first printer 18.

The first video camera 28*a* detects the lines 62 of the binary code stripe 60 and transmits the code pattern to the computer 46. The computer 46 is then able to determine the absolute position of the paper web 26 at the position of the first video camera 28*a* by decoding the binary information encoded in the lines 62 of the binary code stripe 60. The computer 46 may then also assess the feed velocity of the paper web 26. If, for example, the computer 46 detects that the feed velocity decreases continuously or abruptly, this indicates a malfunction (e.g. paper jam) of components arranged upstream the first video camera 28*a*, in particular of the first printer 18. The computer 46 may then initiate a halt of the pre-proofer 116 and the display of warning or maintenance information to a user.

The signals supplied by the second video camera 28*b* are processed in a similar manner by the computer 46. The absolute position of the paper web 26 determined with the help of the second video camera 28*b* is used to modify (if necessary) the Y coordinate of the paper web when the rear side is printed in the second printer 20. To this end the computer 26 controls pinch rollers 64 contained in the second printer 20 that determine the spatial relationship between the paper web 26 on the one hand and a printing head 66 of the second printer 20 on the other hand. For example, if the second video camera 28*b* detects that the paper web 26 has not advanced far enough, e.g. because of a paper curling between the paper exit 34 of the first printer 18 and the paper entrance 38 of the second printer 20, the computer 46 controls the pinch rollers 64, 64 to accelerate their speed of rotation so that the printing head 66 can print the rear side on the correct Y position of the paper web 26. Therefore the preproofer 116 is able to adjust misalignments only along the Y direction, but not along the X direction, and it cannot compensate for rotations and scaling errors, as has been the case in the pre-printer 16 shown in FIG. 3.

The above description of the preferred embodiments has been given by way of example. From the disclosure given, those skilled in the art will not only understand the present invention and its attendant advantages, but will also find apparent various changes and modifications to the structures and methods disclosed. The applicant seeks, therefore, to cover all such changes and modifications as fall within the spirit and scope of the invention, as defined by the appended claims, and equivalents thereof.

The invention claimed is:

1. An apparatus for producing proof prints on a print medium having a front side and a rear side for which correctness of page impositions can be checked, comprising:

a) a stand configured to receive a roll of print medium, b) a first printer for printing pages on a front side of the print medium fed from the roll of the print medium, c) a second printer for printing pages on a rear side of the print medium, d) a first optical sensor arranged immediately outside of a print medium exit of the first printer, and configured to detect a code stripe printed by the first printer on the front side of the print medium and encoding an absolute Y position of the print medium along a feed direction of the print medium, e) a second optical sensor arranged between the first optical sensor and a print medium entrance of the second printer, and also configured to detect the code stripe, and f) a control unit configured to halt at least the second printer at least if the first optical sensor detects that a feed velocity of the print medium at the print medium exit of the first printer decreases abruptly, and to control the second printer such that the second printer prints the pages on the rear side of the print medium at a correct Y position of the print medium.

2. The apparatus of claim 1, wherein the code stripe contains a binary code.

3. The apparatus of claim 2, wherein the code stripe contains a sequence of lines each containing at least 20 digits.

4. An apparatus for producing proof prints on a print medium having a front side and a rear side for which correctness of page impositions can be checked, comprising:

a) a stand configured to receive a roll of print medium, b) a first printer for printing pages on a front side of the print medium fed from the roll of the print medium, c) a second printer for printing pages on a rear side of the print medium, d) a first optical sensor arranged outside of a print medium exit of the first printer, and configured to detect a code stripe printed by the first printer on the front side of the print medium and encoding an Y position of the print medium along a feed direction of the print medium, e) a second optical sensor arranged between the first optical sensor and a print medium entrance of the second printer, and also configured to detect the code stripe, and f) a control unit configured to modify a spatial relationship between the rear side of the print medium and each of the pages to be printed on the rear side of the print medium depending on the Y position of the print medium encoded by the code stripe that is detected by the second optical sensor.

5. The apparatus of claim 4, wherein the code stripe contains a binary code.

6. The apparatus of claim 5, wherein the code stripe contains a sequence of lines each containing at least 20 digits.

7. A method of using an apparatus for producing a proof print on which correctness of page impositions can be checked, comprising the following steps:

a) utilizing a computer to prepare first pages and second pages;

b) feeding a print medium from a print medium roll into a print medium entrance of a first printer;

c) activating the first printer to print on a front side of the print medium the first pages and a code stripe that encodes an absolute Y position of the print medium along a feed direction of the print medium;

d) arranging a first optical sensor to face the front side of the roll of the print medium, and to detect the code stripe;

e) arranging a second optical sensor to face the front side of the roll of the print medium, and to detect the code stripe;

f) halting at least the second printer if the first optical sensor detects that a feed velocity of the print medium at the print medium exit of the first printer decreases abruptly, and controlling the second printer such that the second printer prints the second pages on the rear side of the print medium at a correct Y position of the print medium.

8. The method of claim 7, wherein the code stripe contains a binary code.

9. The method of claim 8, wherein the code stripe contains a sequence of lines each containing at least 20 digits.

10. The method of claim 7, wherein the print medium is not cut on its way between a print medium exit of the first printer to a print medium entrance of the second printer.

11. A method of claim 7, further comprising the following steps:

i) checking whether the page impositions on the proof print are correct;

ii) if the impositions on the proof print are correct, printing sheets with original impositions in a print press;

iii) if the impositions on the proof print are not correct, the control unit modifies, depending on results obtained in step i), the impositions of the first and/or the second pages.

12. A method of using an apparatus for producing a proof print on which correctness of page impositions can be checked, comprising the following steps:

a) utilizing a computer to prepare first pages and second pages;

b) feeding a print medium from a print medium roll into a print medium entrance of a first printer;

c) activating the first printer to print on a front side of the print medium the first pages and a code stripe that encodes an absolute position of the print medium along a feed direction of the print medium;

d) arranging a first optical sensor to face the front side of the roll of the print medium, and to detect the code stripe;

e) arranging a second optical sensor to face the front side of the roll of the print medium, and to detect the code stripe;

f) modifying a spatial relationship between a rear side of the print medium and the second pages depending on a Y position of the print medium encoded by the code stripe that is detected by the second optical sensor;

g) activating the second printer to print on the rear side of the print medium the second pages.

13. The method of claim 12, wherein the code stripe contains a binary code.

14. The method of claim 13, wherein the code stripe contains a sequence of lines each containing at least 20 digits.

15. The method of claim 12, wherein the print medium is not cut on its way between a print medium exit of the first printer to a print medium entrance of the second printer.

16. The method of claim 12, further comprising the following steps:

i) checking whether the page impositions on the proof print are correct;

ii) if the impositions on the proof print are correct, printing sheets with original impositions in a print press;

iii) if the impositions on the proof print are not correct, the control unit modifies, depending on results obtained in step i), the impositions of the first and/or the second pages.

* * * * *